US005778902A

United States Patent [19]

Nagy

[11] Patent Number: 5,778,902

[45] Date of Patent: Jul. 14, 1998

[54] HAIR COLOR-STICK

[76] Inventor: Christine Nagy, 417 East 72nd St. Apt. 2C, New York, N.Y. 10021

[21] Appl. No.: 759,062

[22] Filed: Dec. 2, 1996

[51] Int. Cl.[6] ..... A45D 34/04

[52] U.S. Cl. ..... 132/200; 132/318; 132/221; 132/208; 401/134; 206/221

[58] Field of Search ..... 132/221, 318, 132/208, 317, 200; 401/133, 134, 40; 206/219, 221, 222

[56] References Cited

U.S. PATENT DOCUMENTS

| | | | |
|---|---|---|---|
| 2,191,254 | 2/1940 | Harmon . | |
| 2,299,296 | 10/1942 | Battle . | |
| 2,809,647 | 10/1957 | Dulberg | 132/317 |
| 3,261,381 | 7/1966 | Roach | 206/219 |
| 3,337,039 | 8/1967 | Knittel et al. | 206/221 |
| 3,351,058 | 11/1967 | Webb | 206/219 |
| 3,410,444 | 11/1968 | Morane | 206/219 |
| 3,532,254 | 10/1970 | Burke | 206/219 |
| 3,684,455 | 8/1972 | Vacirca et al. | 206/219 |
| 4,886,495 | 12/1989 | Reynolds | 206/222 |
| 4,913,172 | 4/1990 | Chou | 132/221 |
| 4,929,109 | 5/1990 | Ikenaga | 401/134 |
| 5,024,243 | 6/1991 | Snyder . | |
| 5,277,303 | 1/1994 | Goyet et al. | 206/219 |
| 5,337,764 | 8/1994 | McKay . | |

FOREIGN PATENT DOCUMENTS

| | | | |
|---|---|---|---|
| 152999 | 9/1982 | Japan | 401/40 |

*Primary Examiner*—Todd E. Manahan
*Assistant Examiner*—E. Robert
*Attorney, Agent, or Firm*—Michael I. Kroll

[57] ABSTRACT

A hair color stick (16) comprising a first cartridge (18) for holding a first hair color solution (20). A second cartridge (22) is for holding a second hair color solution (24). A structure (26) is for fluidly attaching the first cartridge (18) to the second cartridge (22), so that the first hair color solution (20) will mix with the second hair color solution (24). A facility (28) on the second cartridge (22) is for applying a controlled amount of the mixed hair color solution (20), (24) onto a portion of the hair (30) of a person (32), so that the hair (30) can be touched up with the mixed hair color solution (20), (24).

7 Claims, 7 Drawing Sheets

HAIR COLOR-STICK

DESCRIPTION OF THE PRIOR ART

Numerous hair cosmetic device have been provided in prior art. For example, U.S. patents numbered U.S. Pat. No. 2,191,254 to Harmon; U.S. Pat. No. 2,299,296 to Battle; U.S. Pat. No. 5,024,243 to Snyder and U.S. Pat. No. 5,337,764 to McKay all are illustrative of such prior art. While these units may be suitable for the particular purpose to which they address, they would not be as suitable for the purposes of the present invention as heretofore described.

HARMON, WALTER

VANITY COMB

U.S. Pat. No. 2,191,254

A composite pocket-style utility assemblage of the class described comprising a unitary body having longitudinally spaced teeth extending at right angles from one longitudinal edge thereof. The opposite longitudinal edge is provided at its center with a socketed outstanding lug. A relatively shallow groove on one side of the lug terminates at a point inwardly of an adjacent transverse end of the body. A cylinder is formed integral with the last names longitudinal edge of the body. The cylinder is open at its outer end and closed and integral with the lug at its opposite inner end. A nail file has its inner end telescoping into the socket in the lug and is fixed in the socket. One edge of the file is seated in the groove. The file at its outer end is pointed. The pointed end projects beyond the adjacent end of the groove and terminates flush with the adjacent transverse end of the body. One longitudinal edge of the pointed end is spaced from the adjacent surface of the longitudinal edge of the body to provide an intervening V-shaped crotch.

BATTLE, JOSEPH J.

HAIR OPERATOR'S INSTRUMENT

U.S. Pat. No. 2,299,296

An instrument of the character described comprising a tubular handle closed at its rear end. A longitudinal hollow neck extends from the forward end of the handle, and is offset therefrom, and parallel thereto. The neck is formed with a row of spaced openings. Applicator means on the neck is adapted to receive liquid passing through the row of openings.

SNYDER, SUSSAN L.

COMB FOR PRACTICING SELECTIVE HAIR COLORING

U.S. Pat. No. 5,024,243

A method of coloring selected hair shafts with a hair treating material, while leaving adjacent hair shafts untreated, in which hair treating material is laid down simultaneously onto a plurality of generally parallel spaced and non-overlapping areas running along the lay of the hair. A method of touching up hair which has been so treaded, after the roots have grown out. A coloring comb adapted to use in the method. The coloring comb has narrow dispensing gullets separated by plural combing teeth.

McKAY, WILLIAM D.

FLUID DISPENSING COMB

U.S. Pat. No. 5,337,764

A dispensing comb for applying a fluid to the hair has a body with a plurality of teeth formed thereon and at least one, preferably two, fluid reservoirs removably attached to the body such that fluid communication is provided from the reservoirs to the teeth. The two reservoirs have thin seals which rupture when the two reservoirs are interconnected such that two different fluids contained therein intermix. Attachment of the two reservoirs to the comb body similarly causes the puncture of a seal to facilitate fluid communication of the mixed components through the comb to the teeth thereof. In a first embodiment, a pin disposed upon the first reservoir punctures a seal in the second reservoir and two fluids then intermix via a bore in the pin. A similar pin, disposed upon the body, punctures a similar seal in the first reservoir to effect fluid communication from of the mixture from the two reservoirs to the teeth of the comb. In a second embodiment, a serrated annular knife simultaneously cuts through the seals of both reservoirs, thus causing their contents to intermix. A pin, having a bore formed therethrough, facilitates fluid communication from the two reservoirs to the teeth of the comb as in the first embodiment. As such, the dispensing comb of the present invention facilitates the easy and convenient application of two-component hair conditioning mixtures to the user's hair. The need to individually open separate containers, mix the contents thereof in a third container, and disperse the mixture throughout the hair with the hands, is thereby eliminated.

SUMMARY OF THE INVENTION

A primary object of the present invention is to provide a hair color stick that will overcome the shortcomings of the prior art devices.

Another object is to provide a hair color stick in which its absorbent applicator tip will release a mixed hair color solution to color touch up the hair, rather than full hair coloring of grays and some roots.

An additional object is to provide a hair color stick whereby the absorbent applicator tip will break a protective seal when pushed inwardly, to release the mixed hair color solution from two interconnecting cartridges.

A further object is to provide a hair color stick that is simple and easy to use.

A still further object is to provide a hair color stick that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a perspective view showing the instant invention held in a hand, doing a color touch up of the hair of a person.

FIG. 1*a* is an enlarged perspective view of an area as indicated by arrow 1*a* in FIG. 1.

Similar reference characters denote corresponding features consistently throughout the attached drawings.

DETAILED DESCRIPTION OF THE PREFERRED EMBODIMENTS

Figure 1:
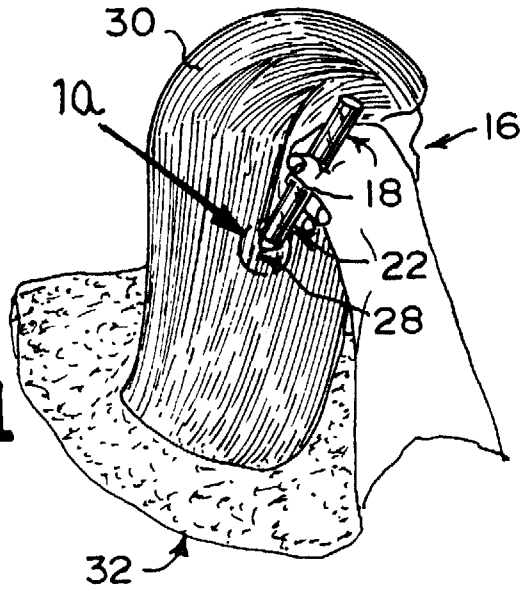
Figure 1A:
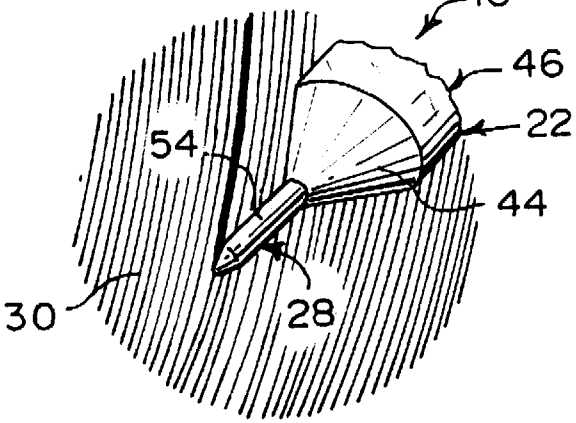

Turning now descriptively to the drawings, in which similar reference characters denote similar elements throughout the several views, FIGS. 1 to 14 illustrate a hair color stick 16 comprising a first cartridge 18, for holding a first hair color solution 20. A second cartridge 22 is for holding a second hair color solution 24. A structure 26 is for fluidly attaching the first cartridge 18 to the second cartridge 22, so that the first hair color solution 20 will mix with the second hair color solution 24. A facility 28 on the second cartridge 22 is for applying a controlled amount of the mixed hair color solution 20, 24 onto a portion of the hair 30 of a person 32, so that the hair 30 can be touched up with the mixed hair color solution 20, 24.

The first cartridge 18 is a first cylindrical barrel 34, having a flat closed end 36 and an open end 38 with a first chamber 40 thereon for the first hair color solution 20. The second cartridge 22 is a second cylindrical barrel 42, having a conical closed end 44 and an open end 46 with a second chamber 48 therein for the second hair color solution 24.

The attaching structure 26 includes the first cylindrical barrel 34, having external threads 50 about the open end 38. The second cylindrical barrel 42 has internal threads 52 within the open end 46. The external threads 50 on the open end 38 of the first cylindrical barrel 34 can engage with the internal threads 52 in the open end 46 of the second cylindrical barrel 42, to allow the first hair color solution 20 within the first chamber 40 to mix with the second hair color solution 24 within the second chamber 48.

Figure 9:
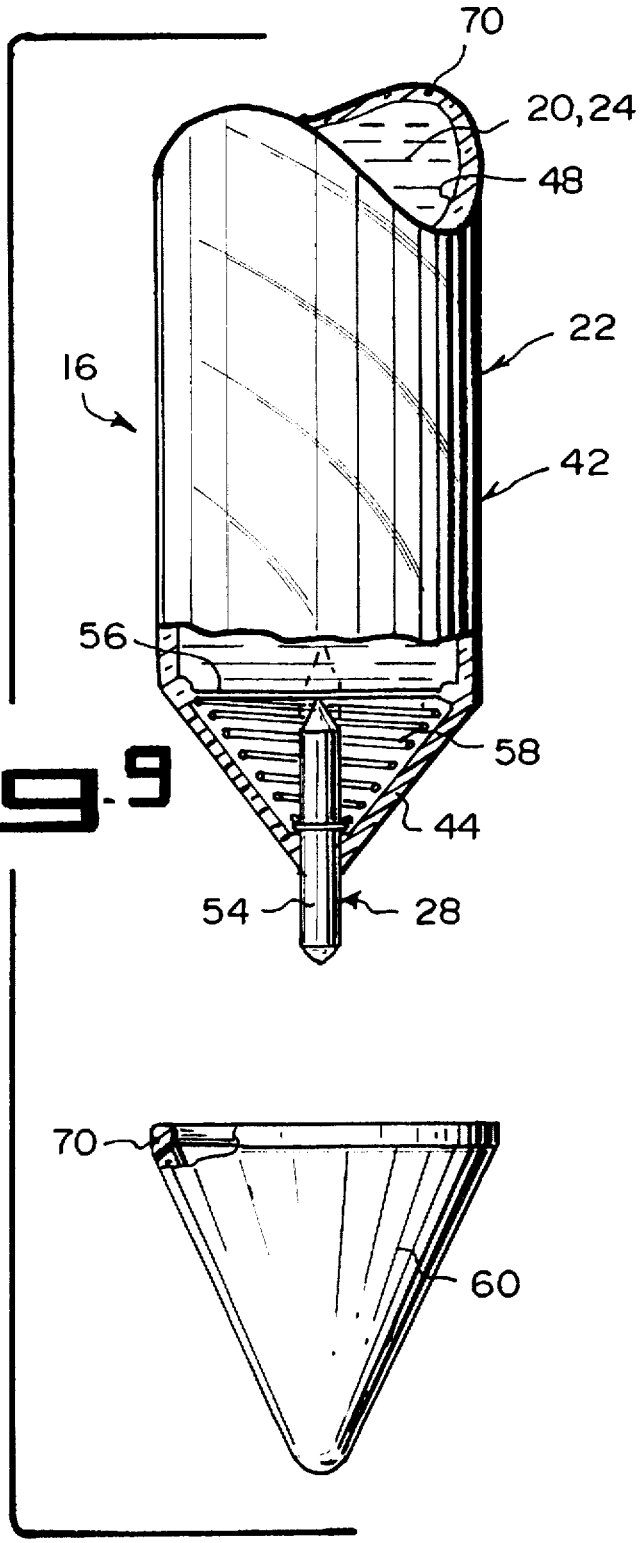
FIG. 9 is an enlarged exploded elevational view of the area indicated by arrow 9 in FIG. 8, with parts broken away and in section.

The applying facility 28, as best seen in FIG. 9, consists of an absorbent applicator tip 54 extending through the conical closed end 44 of the second cylindrical barrel 42. A protective seal 56 is across the second chamber 48 of the second cylindrical barrel 42, above the absorbent applicator tip 54. A conical spring 58 is within the conical closed end 44 of the second cylindrical barrel 42, to normally bias the absorbent applicator tip 54 away from the protective seal 56. When the absorbent applicator tip 54 is manually pressed inwardly to overcome the conical spring 58, the protective seal 56 will break to release some of the mixed hair color solution 20, 24 into the conical closed end 44 of the second cylindrical barrel 42. A conical protective cap 60 snaps onto the conical closed end 44 of the second cylindrical barrel 42, to cover the absorbent applicator tip 54.

Figure 8:
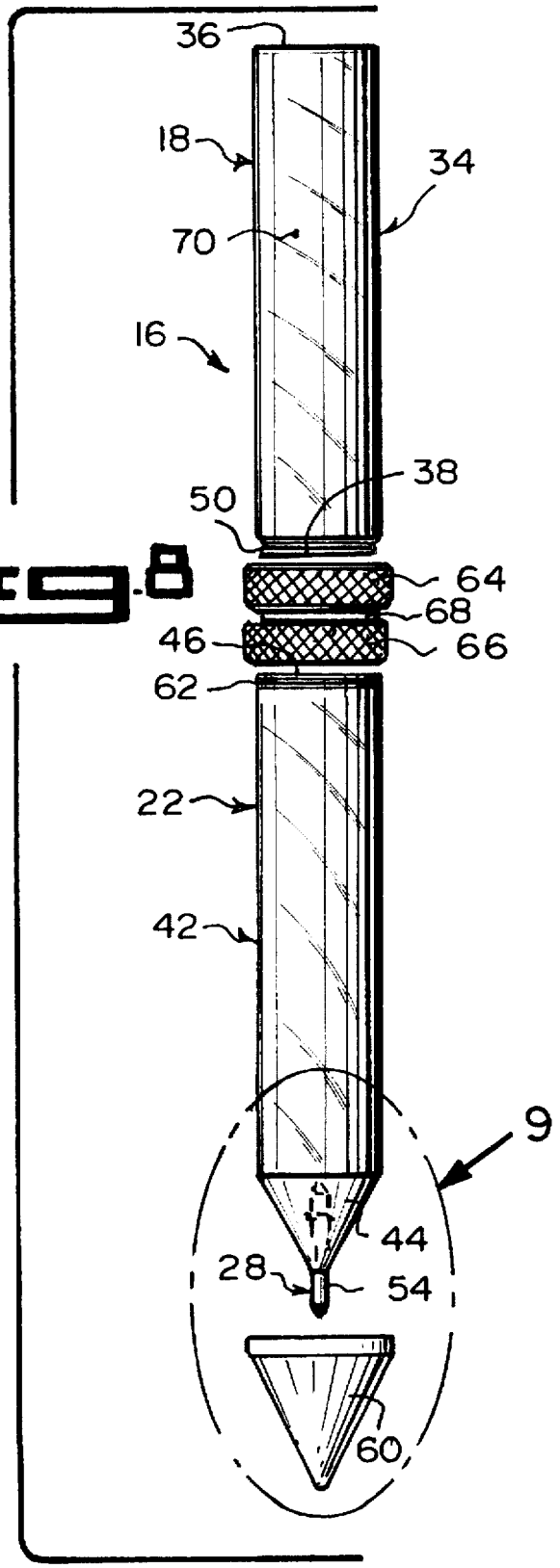
FIG. 8 is an exploded elevational view taken in the direction of arrow 8 in FIG. 2.

The second cylindrical barrel 42 has external threads 62 about the open end 46. A first knurled thumbscrew cap 64 has internal threads to engage with the external threads 50 about the open end 38 of the first cylindrical barrel 34, so as to maintain the first hair color solution 20 therein. A second knurled thumbscrew cap 66 has internal threads to engage with the external threads 62 about the open end 46 of the second cylindrical barrel 42, so as to maintain the second hair color solution 24 therein. A connector member 68, as shown in FIG. 8, will affix the first knurled thumbscrew cap 64 to the second knurled thumbscrew cap 66, before the first hair color solution 20 is mixed with the second hair color solution 24.

The first cartridge 18 and the second cartridge 22 are fabricated out of a strong durable plastic material 70. The conical protective cap 60 is fabricated out of the strong durable plastic material 70. The first knurled thumbscrew cap 64 and the second knurled thumbscrew cap 66 are both fabricated out of the strong durable plastic material 70. The connector member 68 is also fabricated out of the strong durable plastic material 70.

OPERATION OF THE INVENTION

Figures 2, 3, 4:
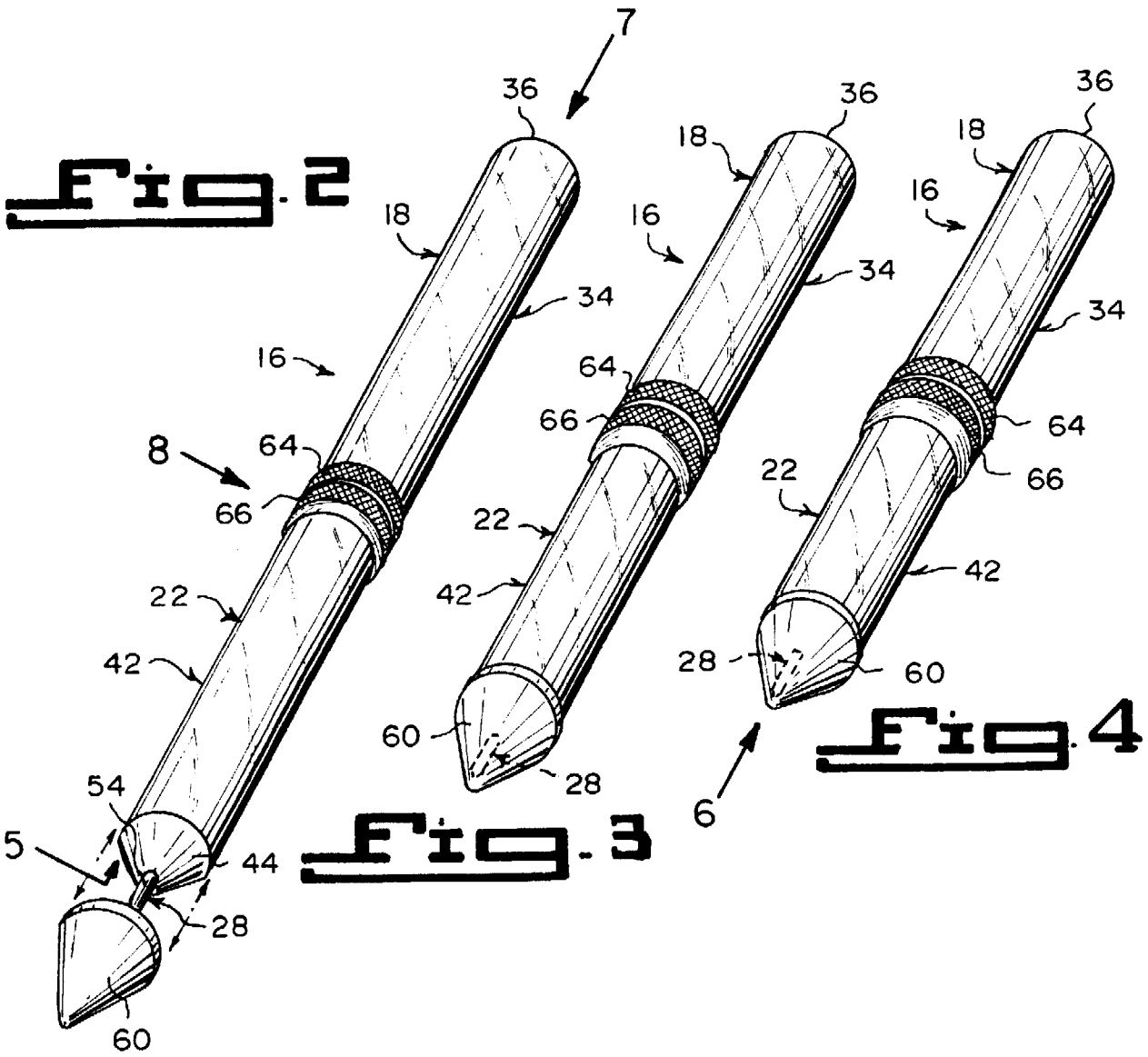
FIG. 2 is a perspective view of the instant invention as a large size with a protective cap partly removed therefrom.
FIG. 3 is a perspective view of the instant invention similar to FIG. 2, but as a medium size with the protective cap installed thereon.
FIG. 4 is a perspective view of the instant invention similar to FIG. 3, but as a small size.
Figure 5:
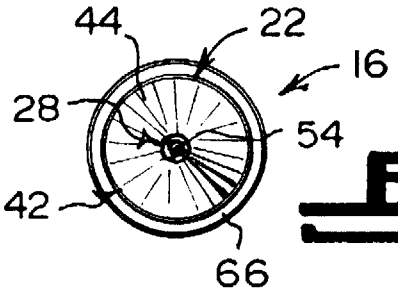
FIG. 5 is a front end view taken in the direction of arrow 5 in FIG. 2, showing the absorbent applicator tip before the protective cap is in place.
Figure 7:
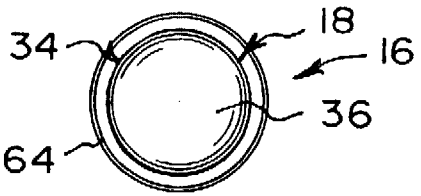
FIG. 7 is a back end view taken in the direction of arrow 7 in FIG. 2.
Figure 6:
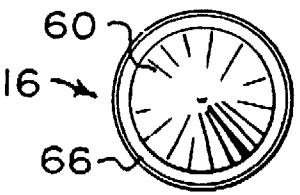
FIG. 6 is a front end view taken in the direction of arrow 6 in FIG. 4, showing the protective cap in place.
Figure 11:
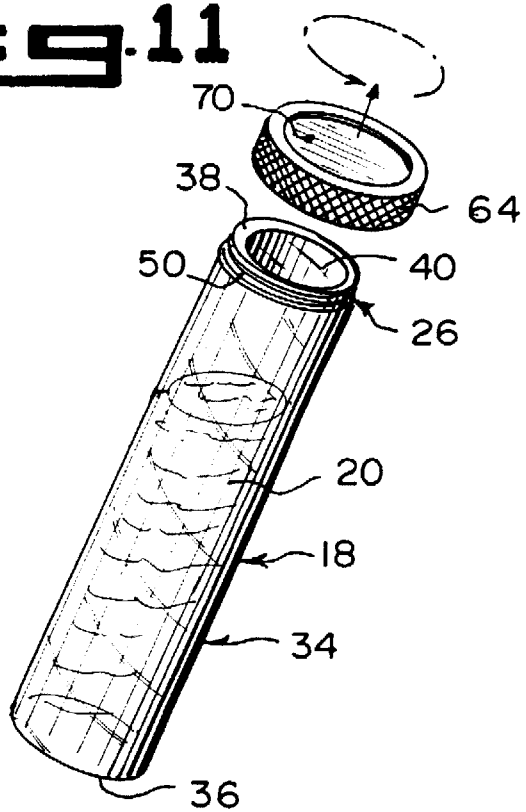
FIG. 11 is a perspective view showing the first thumbscrew cap being removed from the first cartridge.
Figure 10:
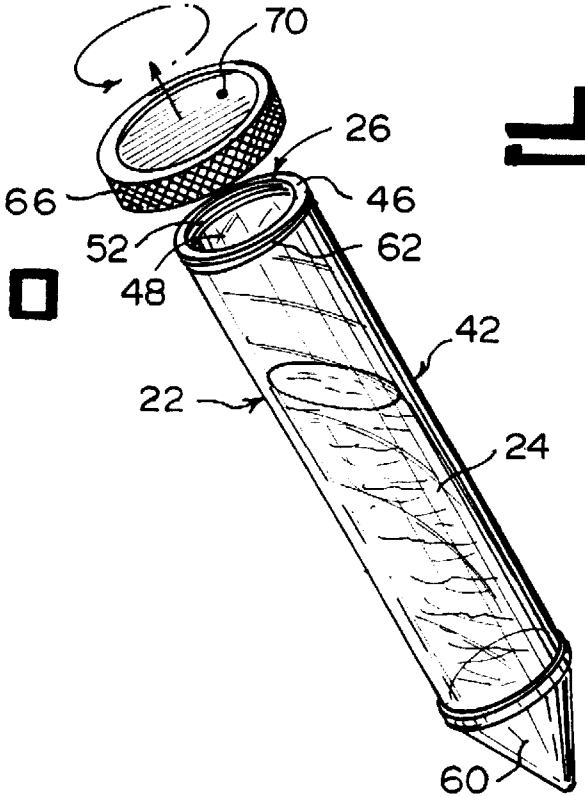
FIG. 10 is a perspective view showing the second thumbscrew cap being removed from the second cartridge.
Figure 13:
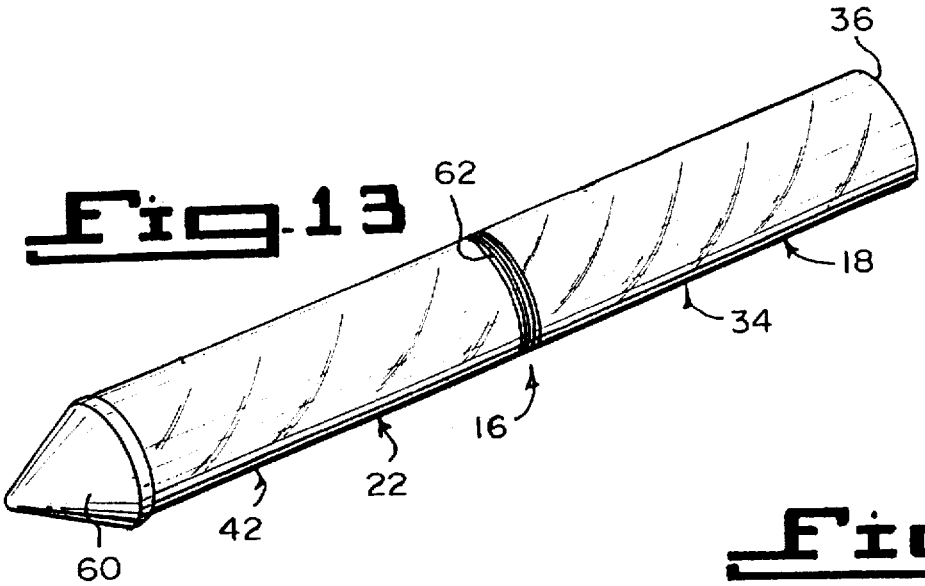
FIG. 13 is a perspective view showing the first cartridge fluidly attached to the second cartridge.
Figure 12:
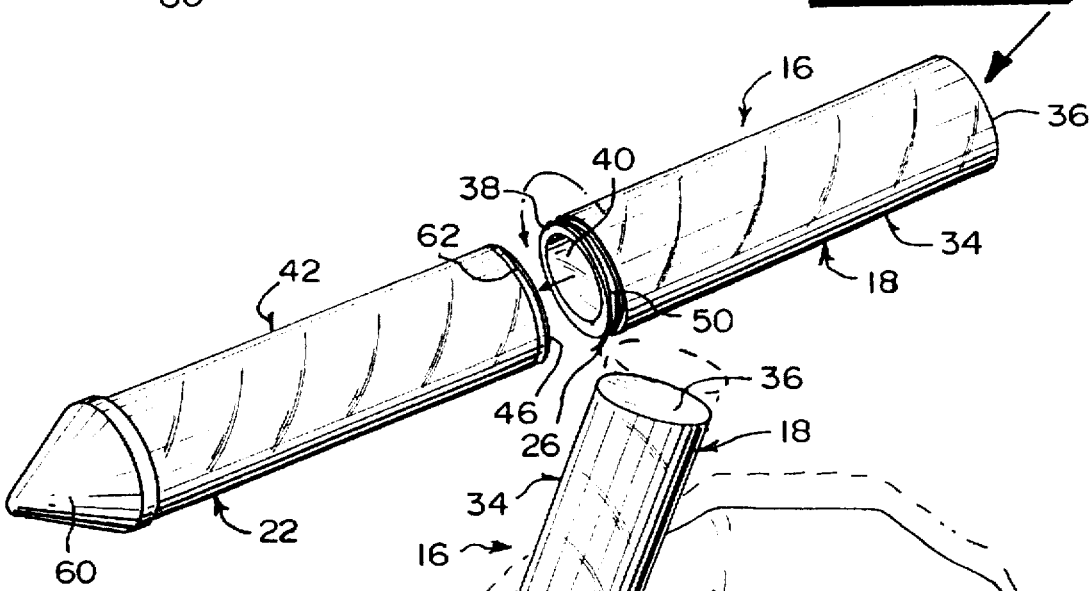
FIG. 12 is a perspective view showing the first cartridge ready to be fluidly attached to the second cartridge.
Figure 14:
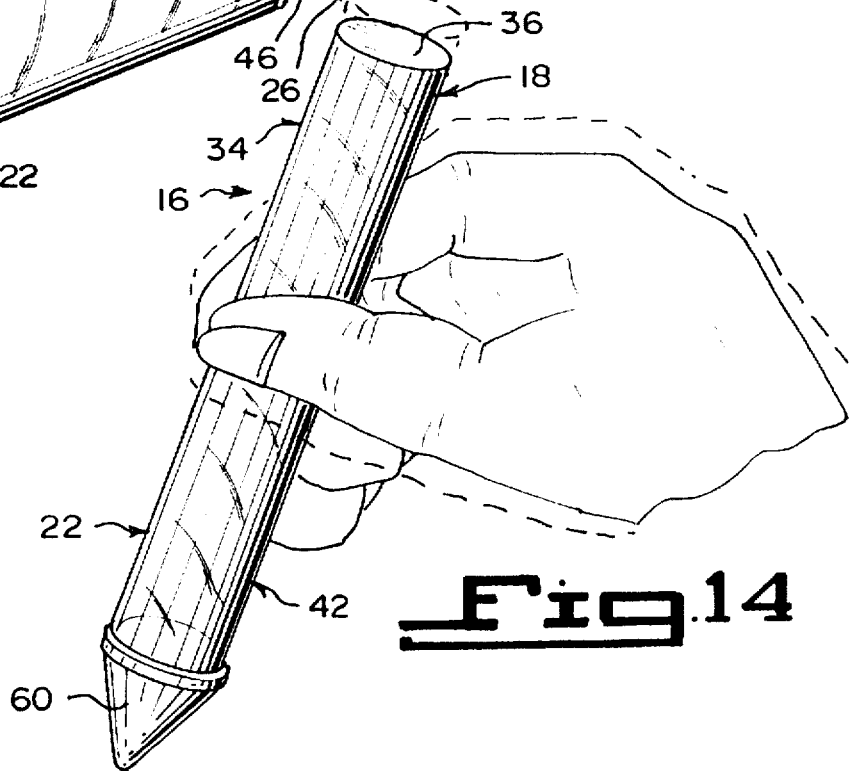
FIG. 14 is a perspective view showing the two hair color solutions being mixed by shaking between the two cartridges before being applied to the hair.

To use the hair color stick 16, the following steps should be taken:

1. Remove the connector member 68 from between the first knurled thumbscrew cap 64 and the second knurled thumbscrew cap 66.
2. Disengage the first knurled thumbscrew cap 64 from the external threads 50 about the open end 38 of the first cylindrical barrel 34, as shown in FIG. 11.
3. Disengage the second knurled thumbscrew cap 66 from the external threads 62 about the open end 46 of the second cylindrical barrel 42, as shown in FIG. 10.
4. Engage the external threads 50 on the open end 38 of the first cylindrical barrel 34 with the internal threads 52 in the open end 46 of the second cylindrical barrel 42, as shown in FIGS. 12 and 13.
5. Shake the first cylindrical barrel 34 and the second cylindrical barrel 42, so as to mix the first hair color solution 20 and the second hair color solution 24 together, as shown in FIG. 14.
6. Take off the conical protective cap 60 from the conical closed end 44 of the second cylindrical barrel 42, as shown in FIGS. 2, 8 and 9.
7. Press the absorbent applicator tip 54 inwardly to overcome the conical spring 50 and break the protective seal 56, to release some of the mixed hair color solution 20, 24, as shown in FIG. 9.
8. Apply a controlled amount of the mixed hair color solution 20, 24 on a portion of the hair 30 of the person 32 to touch up the hair 30, as shown in FIGS. 1 and 2.

LIST OF REFERENCE NUMBERS

16 hair color stick
18 first cartridge of 16

20 first hair color solution in 18
22 second cartridge of 16
24 second hair color solution in 22
26 attaching structure of 16
28 applying facility of 16
30 hair on 32
32 person
34 first cylindrical barrel for 18
36 flat closed end of 34
38 open end of 34
40 first chamber in 34
42 second cylindrical barrel for 22
44 conical closed end of 42
46 open end of 42
48 second chamber in 42
50 external threads of 26 on 34 at 38
52 internal threads of 26 on 42 in 46
54 absorbent applicator tip of 28
56 protective seal of 28 in 48
58 conical spring of 28 in 44
60 conical protective cap of 16
62 external threads on 42 at 46
64 first knurled thumbscrew cap of 16
66 second knurled thumbscrew cap of 16
68 connector member for 64 and 66
70 strong durable plastic material for 18, 22, 60 and 66

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A hair color stick comprising:

a) a first cartridge for holding a first hair color solution comprising a first cylindrical barrel having a flat closed end and an open end with a first chamber therein containing said first hair color solution and having external threads about the open end thereof;

b) a second cartridge for holding a second hair color solution comprising a second cylindrical barrel having a conical closed end and an open end with a second chamber containing the second hair color solution and having external threads about the open end thereof;

c) a first knurled thumbscrew cap having internal threads engaged with the external threads on said first cylindrical barrel to maintain the first hair color solution within said first barrel;

d) a second knurled thumbscrew cap having internal threads engaged with the external threads on said second cylindrical barrel to maintain the second hair color solution within said second barrel;

e) means including a connector affixing said first knurled thumbscrew cap to said second thumbscrew cap forming said hair color stick with said first and second hair color solutions separated from each other;

f) the open end of said second barrel having internal threads engageable with the external threads on the open end of said first barrel so that upon removal of said connector and first and second thumbscrew caps said first barrel may be threadably connected to said second barrel so that the first hair color solution will mix with the second hair color solution;

g) means on said second cartridge comprising an absorbent applicator tip extending through said conical closed end of said second cylindrical barrel for applying a controlled amount of the mixed hair color solution onto a portion of the hair of a person, so that the hair can be touched up with the mixed hair color solution; and h) a protective seal across said second chamber of said second cylindrical barrel above said absorbent applicator tip and a conical spring within said conical closed end to normally bias said absorbent applicator tip away from said protective seal so that when said absorbent applicator tip is manually pressed inwardly to overcome said conical spring said protective seal will break to release some of the mixed hair color solution into said absorber applicator tip.

2. A hair color stick as recited in claim 1, further including a conical protective cap to snap onto said conical closed end of said second cylindrical barrel, to cover said absorbent applicator tip.

3. A hair color stick as recited in claim 1, wherein said first cartridge and said second cartridge are fabricated out of a strong durable plastic material.

4. A hair color stick as recited in claim 1, wherein said conical protective cap is fabricated out of a strong durable plastic material.

5. A hair color stick as recited in claim 1, wherein said first knurled thumbscrew cap and said second knurled thumbscrew cap are both fabricated out of a strong durable plastic material.

6. A hair color stick as recited in claim 1, wherein said connector member is fabricated out of a strong durable plastic material.

7. The method of applying color touch up to hair using a color stick which comprises a first cylindrical barrel for holding a first hair color solution having a flat closed end and an open end with a first chamber containing said first hair color solution and having external threads about the open end thereof, a second cylindrical barrel holding a second hair color solution with a conical closed end having an applicator tip and seal means which is pierced when said applicator tip is pressed and an open end with a second chamber containing the second hair color solution and having external threads about the open end thereof, a first knurled thumbscrew cap having internal threads engaging the external threads on said first cylindrical barrel to maintain the first hair color solution within said first barrel, a second knurled thumbscrew cap having internal threads engaging the external threads on said second cylindrical barrel to maintain the second hair color solution within said second barrel, the open ends of said first and second barrels having threads engageable with each other, and a connector affixing said first knurled thumbscrew cap to said second thumbscrew cap forming said hair color stick with said first and second hair color solutions separated from each other, said method comprising the steps of:

a) removing said connector to disengage said first and second cylindrical barrels from each other;

b) removing said thumbscrew caps from the open ends of said first and second cylindrical barrels;

c) threading the open ends of said first and second barrels together to permit mixing of said first and second color solutions; and d) pressing said applicator tip into the hair to be dyed piercing said seal means and releasing said color solutions.

* * * * *